US005833058A

United States Patent [19]

Mabry

[11] Patent Number: 5,833,058

[45] Date of Patent: Nov. 10, 1998

[54] SAFETY BAGS FOR FLUID SAMPLE CONTAINERS

[75] Inventor: Ronald D. Mabry, Orchard Park, N.Y.

[73] Assignee: Flexo Transparent, Inc., Buffalo, N.Y.

[21] Appl. No.: 984,971

[22] Filed: Dec. 4, 1997

Related U.S. Application Data

[60] Provisional application No. 60/032,140, Dec. 9, 1996.

[51] Int. Cl.[6] ..... B65D 30/08

[52] U.S. Cl. ..... 206/204; 206/524.3

[58] Field of Search ..... 206/204, 524.2, 206/524.3, 484, 569; 383/101, 103, 105, 109, 113, 117

[56] References Cited

U.S. PATENT DOCUMENTS

| | | | |
|---|---|---|---|
| 4,702,377 | 10/1987 | Grone | 206/557 |
| 4,861,632 | 8/1989 | Caggiano | 428/35.2 |
| 4,927,010 | 5/1990 | Kannankeril | 206/204 |
| 4,984,907 | 1/1991 | Power | 383/109 |
| 5,199,795 | 4/1993 | Russo et al. | 206/204 X |
| 5,346,312 | 9/1994 | Mabry et al. | 383/113 |
| 5,697,200 | 12/1997 | Insley et al. | 206/204 X |

FOREIGN PATENT DOCUMENTS 4128166 4/1992 Japan .

*Primary Examiner*—Jacob K. Ackun
*Attorney, Agent, or Firm*—Marianne Fuierer; Howard M. Ellis

[57] ABSTRACT

A disposable safety bag for storage and transporting fluid containers filled with potentially hazardous liquids comprises a separate compartment for holding any spilled or leaking fluid to avoid exposure to handlers. The safety bag is characterized by fluid impermeable exterior walls forming an interior chamber with a fluid tight closure. The interior chamber is subdivided by at least one ply of one-way porous film forming a primary compartment and at least one secondary compartment for entrapping and retaining leaking hazardous liquids. The one-way porous film characterized by tapered protuberance provides one-way flow channels from the primary compartment which holds the fluid sample container. The secondary compartment also contains an absorbent material for retaining excess fluid spilled or leaking from containers in the primary compartment. The combination of one-way porous film plies and absorbent insert minimizes backflow of liquid to the primary compartment.

25 Claims, 4 Drawing Sheets

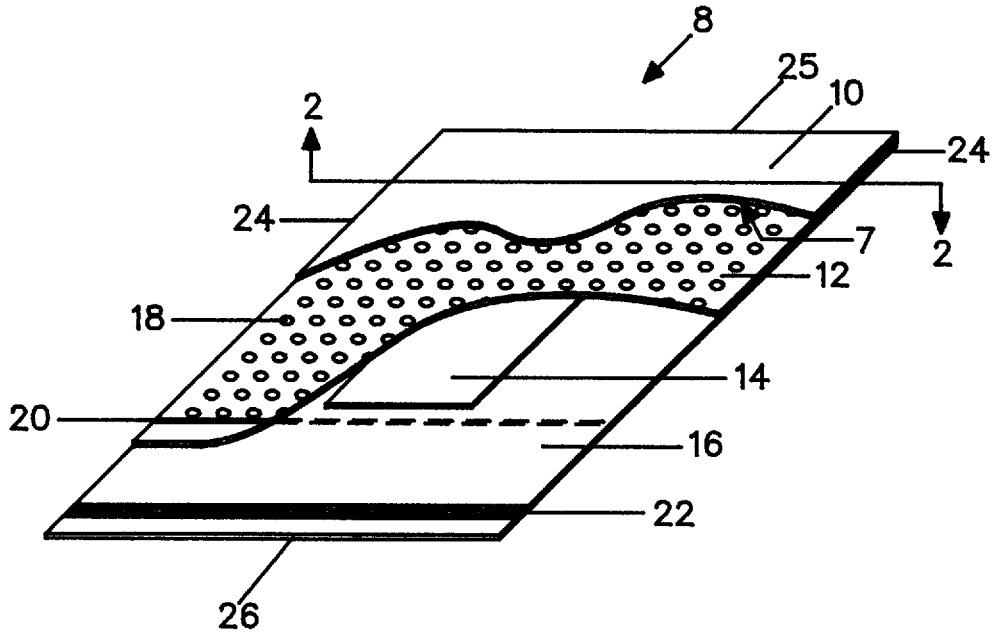
Fig. 1
Fig. 2
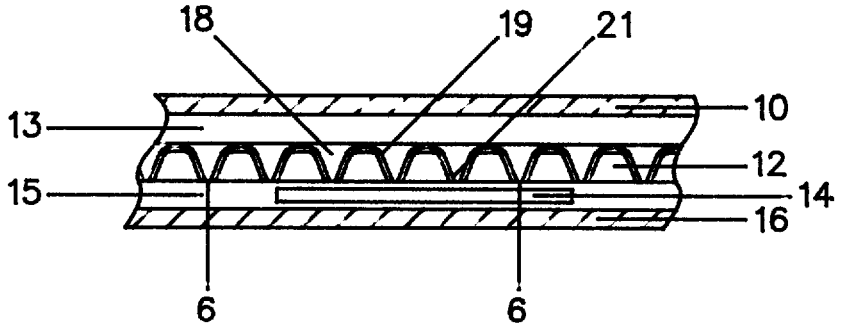

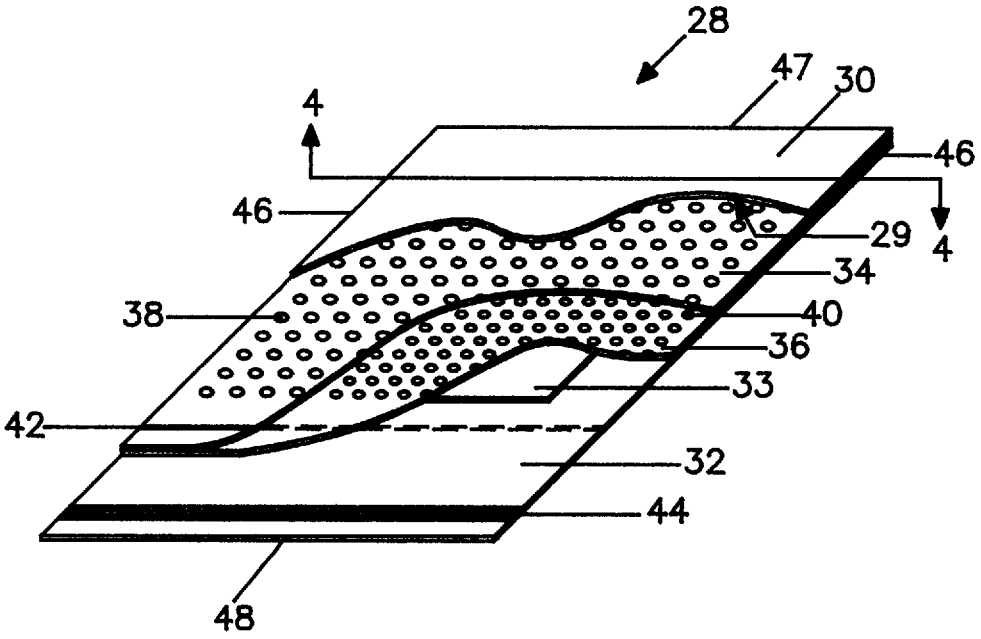
Fig. 3
Fig. 4
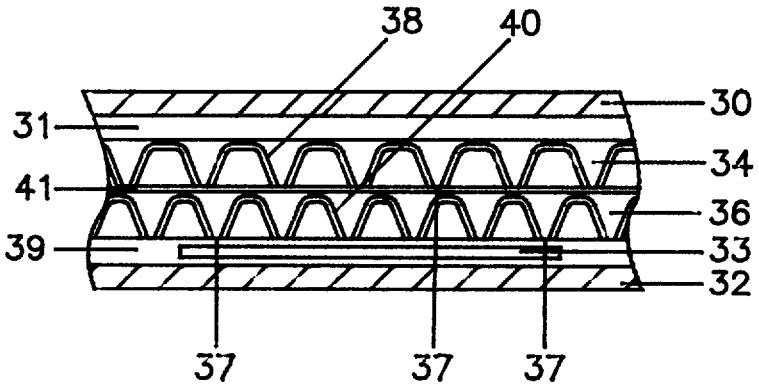

SAFETY BAGS FOR FLUID SAMPLE CONTAINERS

CROSS REFERENCE TO RELATED APPLICATION

This application claims the benefit of U.S. Provisional application Ser. No. 60/032,140 filed Dec. 9, 1996.

TECHNICAL FIELD

This invention relates to safety bags for the storage and transporting of fluid sample containers, and especially disposable safety bags with a fluid tight closure, comprising a primary compartment for holding a fluid sample container and at least one secondary compartment containing an absorbent material, wherein leaking fluid from the primary compartment is retained in the secondary compartment thereby providing an additional level of protection from damaged or leaking fluid sample containers.

BACKGROUND OF THE INVENTION

In the process of storing and transporting fluid samples, particularly containers of body fluids, a number of mishaps can occur, contaminating the sample or making it impossible to safely retrieve a usable quantity for testing. In both medical and environmental testing, there is always the chance of broken vials or improperly secured caps on sample containers. With the possible difficulty and cost of obtaining samples, whether blood, urine, lymphatic fluid in medical testing, etc., or contaminated well water, hazardous sewage in environmental testing, it is imperative to maintain the safety of the samples until they can be tested in the lab. Also important is the safety of laboratory personnel, considering that contact with broken vials which contain potentially hazardous fluids, can present a life threatening situation. Body fluid samples have the potential of being contaminated with numerous viruses such as HIV, Hepatitis A and B and other communicable diseases, while environmental testing includes such toxic chemicals as PCBs, heavy metals, and hazardous organics which all introduce an element of inherent danger. The optimal container for storage and transferring fluid samples is glass because of its inertness, but the fragility of glass is a downside risk for this application. If breakage occurs the laboratory technician is faced with the choice of discarding the sample or trying to retrieve a portion of the sample without the remnants of broken glass. Either situation is unfavorable and an alternative choice is needed.

To overcome the problems associated with transporting containers that carry fluid samples gathered in medical and environmental testing various containers have been developed. Some have been useful by providing an absorbent material to retain some of the spilled fluid sample. Yet, they have not been entirely successful in retaining the fluids in a single reservoir away from the broken container. For example, U.S. Pat. No. 4,861,632 discloses a bag structure having an absorbent pad placed between a water impervious outer layer and a perforated impervious inner layer. However, if there is an excess of fluid beyond that which is absorbed by the absorbent pad the perforated impervious inner layer cannot prevent the backflow of the excess fluid into the sample holding compartment. Likewise, U.S. Pat. No. 4,927,010 discloses a shipping bag constructed with impervious outer panels and liquid permeable inner panels. An absorbent material is placed between the outer and inner panels. The liquid permeable inner panels are comprised of hydrophobic nonwoven filamentary material. This type of material allows spilled fluids in the holding compartment to pass through the inner fibrous layer but will not offer any protection from excess fluid seeping back into the holding compartment of the shipping bag.

Heretofore, compartmentalized bags have been developed which allow small amounts of moisture escaping from food products to drain into a separate compartment and thereby separate the moisture from the food compartment. Power (U.S. Pat. No 4,984,907) discloses a package having an outer plastic surface lined with an absorbent material. The absorbent liner is in turn completely overlaid by a grid or netting formed of a heat resistant material like TEFLON®. This grid type material allows small amounts of grease or moisture to drain through into the absorbent material but will not restrict possible backflow of larger quantities of fluids. One particularly useful bag is disclosed by Mabry et al. in U.S. Pat. No. 5,346,312. This invention includes a bag with a food compartment for storage of hot food and a separate reservoir compartment for the retention of escaping water vapors, condensation from steam, and oil residuals. These compartments are separated by a liner fabricated from a one-way porous film that allows fluids escaping from hot food to drain into the reservoir compartment. The steam and volatile molecules migrate through the one-way pores into the reservoir where they are trapped, thereby limiting reabsorption by the food products. The one-way pores because of a unique funnel shape, inhibit the back flow of fluid into the food storage compartment. While one-way porous films are generally effective in restricting unwanted back flow of a small amount of liquid from re-entering the compartment of their origin, this inventor found that such films are not always efficient in restricting back flow of larger fluid volumes.

Because fluid samples obtained or gathered in medical and environmental testing are usually in much larger volumes than found in food preservation the increased hydrostatic pressure on the interior walls of a compartment causes the one-way porous film to be less efficient in restricting the backflow of fluid into the sample containing compartment.

Accordingly, there is a need for a more efficient safety bag for fluid sample containers holding larger volumes of fluid which will assure separation and collection of fluid escaping from damaged or leaking containers.

SUMMARY OF THE INVENTION

It is a principal object of this invention to provide safer packaging for storage and transporting fluid samples and to increase the likelihood of safely retrieving an analyzable sample in the event the sample container is damaged or leaking. This object is achieved principally through a safety bag comprising at least first and second non-porous exterior side walls, the exterior side walls having an inner and outer surface. The first and second side walls are joined on the peripheral edges to form an interior chamber having an opening for access into the interior chamber. The opening includes means for forming a fluid tight closure or seal. The interior chamber is subdivided into a primary compartment for receiving and storing fluid sample containers and at least one secondary compartment for collecting and retaining fluid from spilled, damaged or leaking sample containers in the primary compartment. The interior chamber is separated by at least one interior side wall formed of a one-way porous film. The interior side wall is positioned within the interior chamber adjacent to the inner surface of the non-porous exterior side wall and joined therewith on the peripheral edges so as to form the secondary compartment. The one-way porous film comprises a plurality of tapered protuberances having a generally funnel-like configuration narrowing in the direction of the non-porous exterior side wall and extending into the secondary compartment. The one-way pores allow any fluid leaking from a fluid sample container in the primary compartment to discharge through the pore opening into the secondary compartment while reducing backflow of fluid from the secondary compartment to the primary compartment. The non-porous exterior side wall may be sealed to the one-way porous interior side wall below the fluid tight closure thereby forming a sealed secondary compartment.

In a preferred embodiment, the sealed secondary compartment includes means for absorbing the discharging fluid from the primary compartment. In the event of breakage or spillage from a fluid sample container having from about a milliliter to about several ounces of fluid sample the one-way porous film readily allows passage of the fluid into the secondary compartment where an absorbing material traps the fluid in the sealed secondary compartment. The absorbing material holds the escaping fluid while the one-way pores reduce the back flow from the secondary compartment into the primary compartment. Isolating the fluid in the secondary compartment eliminates the burdensome and sometimes hazardous separation of fluid from a damaged sample container which can expose lab personnel to the remnants of broken glass and introduce the risk of a serious injury or exposure to a communicable disease.

While this first embodiment of the invention is disclosed herein with a single secondary compartment adjacent to the primary compartment, this inventor contemplates safety bags also having dual secondary compartments, one adjacent to each of the non-porous exterior side walls.

In an alternate preferred embodiment of the invention, the safety bag comprises at least a first and second non-porous exterior side walls, the exterior side wall having an inner and outer surface. The first and second side walls are joined on the peripheral edges to form an interior chamber, having an opening for access into the interior chamber. The opening includes means for forming a fluid tight closure. The interior chamber is subdivided into a primary compartment for receiving and storing fluid sample containers and at least one secondary compartment for collecting fluid spilled from a damaged or leaking sample container in the primary compartment. The interior chamber is separated by at least one interior side wall formed by non-laminated multiple plies of one-way porous film, and more specifically at least two plies of non-laminated one-way porous film. The multiple plies of one-way porous film comprise a plurality of tapered protuberances having a generally funnel-like configuration narrowing in the direction of the non-porous exterior side wall. The protuberances from the inner most ply extend into the secondary compartment. The one-way pores allow any fluid leaking or spilled from a fluid container in the primary compartment to drain through into the secondary compartment and reduce the backflow of fluids from the secondary compartment back into the primary compartment. The non-porous exterior side wall may be sealed to the one-way porous interior side wall below the fluid tight closure thereby forming a sealed secondary compartment. The sealed secondary compartment also includes means for absorbing the discharged fluid from the primary compartment. Utilizing at least two plies of non-laminated one-way porous film in juxtaposition with one another offers additional protection from back flow into the primary compartment.

As in the first embodiment of the invention, this second embodiment contemplates two or more secondary compartments depending on the style of the bag, wherein each secondary compartment is separated from the primary compartment with at least two plies of the porous one-way film.

It is a further object of the invention to provide various styles of bag construction for the safety bags including, sandwich style, flat and tubular styles having dual opposing side walls sealed to one another along peripheral edges. Such bags may have an expandable bottom wall with gussets, thereby offering additional areas to insert a means for absorption. Similarly, bags of the invention may have expandable side walls. The invention also contemplates bags having opposing quadrilateral side walls and a bottom wall with a porous one-way film separator, comparable in shape to foldable kraft style bags to increase holding capacity.

BRIEF DESCRIPTION OF THE DRAWINGS

FIG. 1 is a isometric view of a non-expanded safety bag, of the present invention, with a portion of the first non-porous exterior side wall broken away to provide a view of absorbent material insert and the one-way porous barrier film;

FIG. 2 is an enlarged sectional view of the side wall taken along 2—2 of FIG. 1;

FIG. 3 is an isometric view of a non-expanded safety bag of the invention, with a portion of the first non-porous exterior side wall broken away to provide a view of the multiple plies of one-way porous barrier film;

FIG. 4 is an enlarged sectional view of the side wall taken along 4—4 of FIG. 3;

DETAILED DESCRIPTION OF THE PREFERRED EMBODIMENTS

Figure 5:
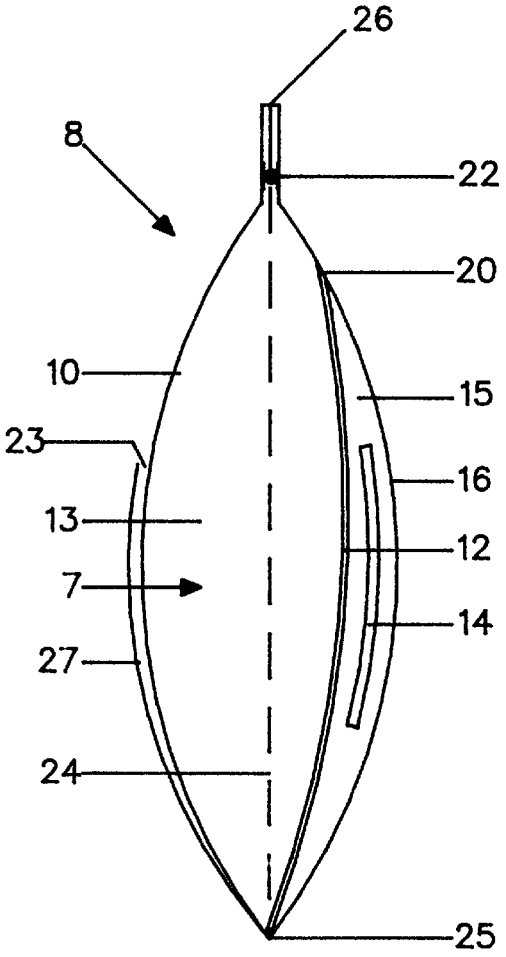
FIG. 5 is an end elevational view of the safety bag in FIG. 1 when filled.

FIGS. 1, 2, and 5 illustrate a preferred embodiment of a safety bag 8, which comprises non-porous first and second exterior side walls 10 and 16, bonded by heat sealing along two or three of their peripheral side edges 24 and 25, terminating at opening 26, to form a two sided bag or envelope-like structure with an interior chamber 7. Opening 26 may be closed and sealed by any of the commonly known fluid tight closures 22 for plastic bags, for example, snapping channel, reclosable zipper or the equivalent.

Suitable materials for the non-porous exterior side walls 10 and 16 typically include pliable films which are strong, tough and fluid impermeable. In accordance with the preferred embodiment of the present invention, suitable material include polymeric films, such as polyolefin films, including such representative examples as polypropylene or polyethylene, both high and low density including blends and copolymers of the same. Other suitable materials may include films of polyvinylchloride, polyesters, such as polyethylene terephthalate, and nylons.

The exterior side walls 10 and 16 have a thickness sufficient to maximize protection from damaged fluid sample containers stored within the safety bag and to resist puncture by any sharp objects contained in the interior chamber 7, preferably in the thickness range of 2 to 6 mils.

The interior chamber 7 is compartmentalized by an interior side wall 12 comprising a one-way porous barrier film thereby forming a primary compartment 13 for introducing and storage of fluid containers (not shown) and an adjacent secondary compartment 15 for receiving and retaining fluids inadvertently discharged from containers in the primary compartment. The interior side wall of one-way porous barrier film 12 consists of a flexible film having a plurality of pores or perforations 18 penetrating the film. Pores 18 are in close proximity to one another and regularly spaced as opposed to being random. The pores provide flow channels for fluid discharged from spilled or leaking fluid containers located in the primary compartment 13 to the secondary compartment 15. Pores 18 shown in FIG. 2 are characterized as tapered protuberances 6 having generally a conical or funnel-like shape. The pore geometry may vary depending on the manufacturer of the film. The one-way porous barrier film 12 is oriented so that the tapered protuberances 6 project into the secondary compartment 15 allowing fluid from the primary compartment 13 to readily flow into the secondary compartment. The protuberances 6, which conically converge from a wider pore opening 19 to a narrower opening 21, project or extend into the secondary compartment 15, and restrict back flow of fluid into the primary compartment 13.

Any non-absorbent flexible film having a regular pattern of tapered protuberances that provides a substantially one-way flow of fluids from the primary compartment to the secondary compartment may be used in the present invention. One brand of commercially available one-way porous barrier film is from Tredegar Film Products, Richmond, Va., which offers a porous film having funnel or conically shaped pores, under the registered trademark, VisPore®. Preferred grades of the VisPore® brand films are characterized by an open area of 15 to 26%, with a mesh size ranging from 8.75 to 40 pores per lineal inch or 88 to 1,840 pores per square inch. The thickness of the porous one-way film can range form 0.75 mils to 4.0 mils and embossed thickness from 10 mils to 50 mils. Some preferred representative grades of the one-way porous films include VisPore® 6606, 6605, 6150 and 6178.

The type of fluid being stored will also be a factor in determining the appropriate mesh and pore size for the most effective separation and retention of fluid in the secondary compartment. Test samples of urine or contaminated well water suggest a safety bag utilizing a mesh size with a greater number of pores per lineal inch to minimize back-flow of the fluid sample from the secondary to the primary compartment. By contrast, a blood sample which has greater viscosity may warrant a safety bag with a reduced mesh size and with a larger pore size. For many applications involving body fluids, VisPore® 6606 grade film for example has been found to effective in restricting back flow of fluid from the secondary compartment to the primary compartment. Persons of ordinary skill in the art will be able to readily determine the grade of one-way porous barrier film to optimize each individual application.

In FIG. 1 the peripheral edges of the second non-porous exterior side wall 16 and the interior side wall of one-way porous barrier film 12 are bonded together, preferably by heat sealing at 20 below the fluid tight closure 22. The bonding of second non-porous exterior side wall 16 and interior side wall of one-way porous barrier film 12 form a sealed secondary compartment 15.

The present invention introduces an absorbent material insert 14, into the sealed secondary compartment 15, including a cellulosic pad or any equivalent inert absorbent material, such as particulate absorbent material for increased surface area and absorbency. Readily available absorbent materials may be used such as sterile cotton with varying thicknesses to increase moisture absorbing capacity. The absorbent material insert may or may not be affixed to the inner surface of non-porous second exterior side wall 16. Other absorbent materials can be incorporated into the insert, such as, a sealed pouch containing charcoal or a desiccant, including calcium chloride, silica gel, etc., to further enhance the absorbing capacity. The absorbent material may be impregnated with a bacteriostatic or fungicidal agent.

The absorbent material should be added in a sufficient amount to absorb fluid leaking from the primary compartment and minimize backflow of liquid from the secondary compartment. The present invention is intended for providing retention of liquids ranging from about a milliliter to much larger quantities utilized in environmental testing. Accordingly, the amount of absorbent material will be dependent upon the sample size. Preferably, in a sufficient amount to absorb from about 1 to about 1000 milliliters of fluid.

In the event of breakage or spillage from a fluid container in the primary compartment the absorbent material insert can be retrieved from the sealed secondary compartment and the fluid sample extracted from the insert by a number of methods, such as, applying pressure, centrifuge, solvent extraction or distillation.

Optionally, the safety bags of the invention may have an open ended storage pouch 27, adjacent to outer surface of the exterior side wall 10 (see FIG. 5 ). Pouch 27 is suitable for a label to identify the patient sample, date, time, etc. The pouch can be fabricated from the same material as the safety bag's exterior sidewalls such as transparent polymeric films. An additional option includes means for closure at the edge of the pouch opening 23 to retain the identification label. In the alternative, the outside surface of the pouch can provide a treated writing surface (not shown), thereby eliminating the need for any additional sample identification labels.

Figure 6:
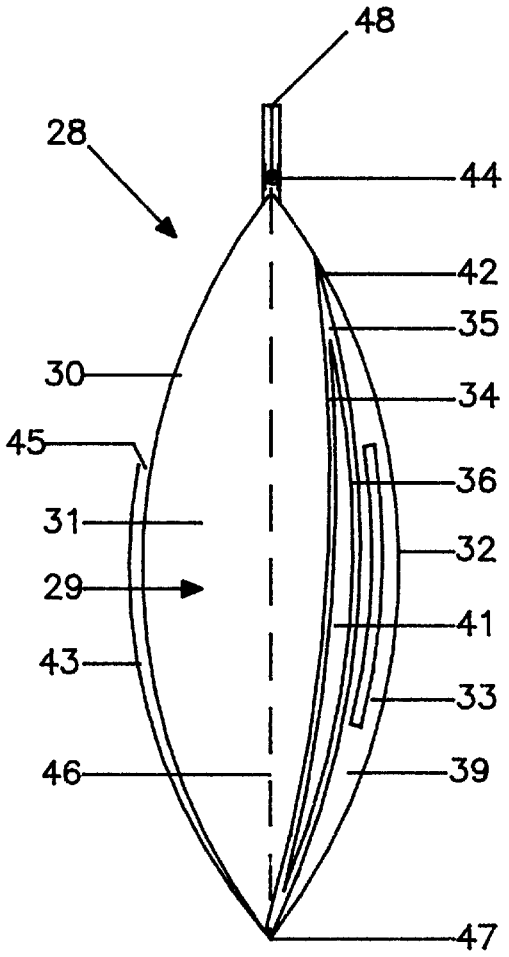
FIG. 6 is an end elevational view of the safety bag in FIG. 3 when filled.

FIGS. 3, 4 and 6 illustrate an alternative embodiment of safety bag 28 comprising non-porous first and second exterior side walls 30 and 32, joined by sealing along peripheral side edges 46 and 47, terminating at opening 48, to form a two sided bag or envelope-like structure with an interior chamber 29. Opening 48 may be closed and sealed by any of the commonly known fluid tight closures 44, for example, snapping channel, reclosable zipper or the equivalent. Suitable materials for the non-porous first and second exterior side walls 30 and 32 typically include pliable sheet materials which are strong, tough, impermeable, and of sufficient thickness to resist puncture from sharp objects. Representative examples include the polymeric films mentioned earlier.

The interior chamber 29 is compartmentalized with at least one interior side wall 35 comprising non-laminated first and second one-way porous barrier film 34 and 36, to form a primary compartment 31 for storage of liquid containers (not shown) and an adjacent secondary compartment 39 for receiving and storing fluids discharged from fluid containers in the primary compartment. The non-laminated first and second one-way porous barrier films 34 and 36, positioned adjacent to each other, consist of a flexible film with a plurality of pores 38 and 40 penetrating the film. More specifically, this embodiment contemplates the non-laminated first and second one-way porous barrier film with the same or different grades of porous film. For example, in FIG. 4, first one-way porous barrier film 34 may have pores 38 which are larger than pores 40 in the second one-way porous barrier film 36. The pores are generally conically shaped protuberances 37. When using two distinct plies of non-laminated one-way porous barrier film, the film plies should be oriented so that the tapered protuberances 37 are oriented towards the secondary compartment 39 allowing fluid from the primary compartment 31 to readily flow through the first and then the second plies and into the secondary compartment 39. The conically shaped protuberances 37 of the first one-way porous barrier film 34 extend into space 41, between the loosely superimposed non-laminated first and second one-way porous plies 34 and 36. The plies of one-way film are adjacent to each other and in some instances can provide a narrow spacing between the plies. Fluid discharged from the primary compartment 31 can follow a path that leading from the pores in the first one-way porous barrier film 34, into and through space 41 when present and into and through the pores in the second one-way porous barrier film 36 and into the secondary compartment 39. The loosely superimposed plies of non-laminated one-way porous barrier film, with their surfaces in contact with the area 41, facilitates an efficient flow of fluid across the two plies of films from the primary compartment 31 to the secondary compartment 39. When choosing different grades of one-way porous barrier film, the VisPore® brand offers a number of options, mentioned earlier, but the specific type of fluid sample should predetermine the size of pores and mesh size.

In FIG. 3 the peripheral edges of the second non-porous exterior side wall 32 and the non-laminated first and second one-way porous barrier films 34 and 36 can be sealed together, preferably by heat sealing at 42, below the fluid tight closure 44, thereby, forming a sealed secondary compartment 39.

While the invention has been described with two different grades of one-way porous barrier film it is to be understood the invention contemplates multiple plies of one-way porous film of the same grade. Furthermore, the shape or geometry of the pores in the one-way film is optional, and can include rectangular, circular, or polygonal such as VisPore® 6170, 6605, or 6582 which typically utilize a hexagonal shape pore in different mesh sizes.

In addition, the pores in each layer of film may be superimposed over each other or offset.

An absorbent insert 33 is introduced into the secondary compartment 39 including those materials discussed earlier.

This embodiment also includes an optional label pouch 43 (see FIG. 6), with an opening 45 for inserting a label and fabricated from the same materials as the safety bag's exterior side walls, as mentioned earlier.

Figure 7:
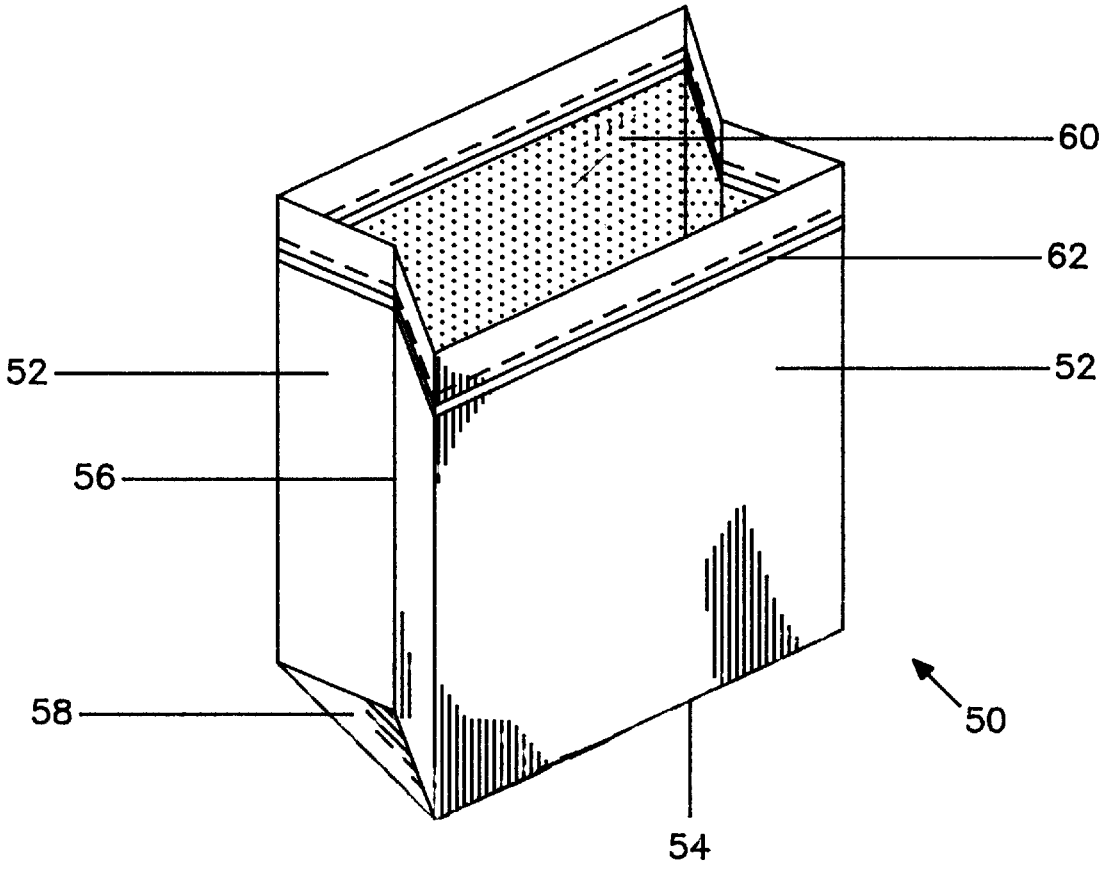
FIG. 7 is an isometric view of an alternative embodiment of the safety bag having expandable quadrilateral side walls.

FIG. 7 is an alternative embodiment of the safety bag of the present invention. Safety bag 50 has four side walls 52, a generally rectangle bottom 54 and a fluid tight closure 62. Side walls are expandable by vertical creasing 56 and a triangular shaped gusset-like member 58 at the base of vertical creasing 56. Bag 50 comprises at least one interior side wall 60 comprising one-way porous film.

While specific materials and details of construction are referred to in connection with the description of the illustrated embodiments, it will be understood that equivalent materials and other details of construction may be resorted to within the spirit of the invention as hereinafter claimed.

I claim:

1. A safety bag for packaging a fluid container comprising:

a) at least first and second non-porous exterior side walls joined to form an interior chamber having an opening for access into said interior chamber;

b) at least one interior side wall comprising one-way porous film positioned within said interior chamber adjacent to said non-porous exterior side walls subdividing said interior chamber into a primary compartment for receiving and storing a fluid container and at least one secondary compartment for retaining fluid discharged from containers in said primary compartment, said interior side wall comprising tapered protuberances extending into said secondary compartment;

c) an absorbent material positioned in said secondary compartment; and d) a fluid tight closure at said opening of said interior chamber.

2. The safety bag of claim 1 fabricated at least in part from a polymeric film.

3. The safety bag of claim 1 wherein said tapered protuberances of one-way porous film have generally funnel-like configuration narrowing in the direction of the non-porous exterior side wall.

4. The safety bag of claim 2 wherein said polymeric film is polyethylene.

5. The safety bag of claim 1 wherein said absorbent material comprises a plurality of layers of cellulosic material.

6. The safety bag of claim 1 wherein said absorbent material is a member selected from the group consisting of cellulosic material, natural sponges, and synthetic sponges.

7. The safety bag of claim 2 wherein said polyolefin film has a thickness from about 2 to about 6 mils.

8. The safety bag of claim 1 wherein said non-porous exterior side wall is sealed to said one-way porous interior side wall below the fluid tight closure thereby forming a sealed secondary compartment having said absorbent material sealed therein.

9. The safety bag of claim 8 wherein said one-way porous interior wall is characterized by regularly spaced pores having an open area of about 15 to about 26 percent.

10. The safety bag of claim 1 comprising two interior side walls positioned within said interior chamber subdividing said interior chamber into a primary compartment and two secondary compartments.

11. The safety bag of claim 10 further comprising exterior means for an identification label.

12. The safety bag of claim 1 wherein said fluid tight closure is a member selected from the group consisting of a reclosable zipper and snap lock strip.

13. The safety bag of claim 6 wherein said absorbent material is impregnated with a member selected from the group consisting of a fungicidal agent and bacteriostatic agent.

14. The safety bag of claim 1 comprising expanding quadrilateral side walls and a bottom wall.

15. The safety bag of claim 1 wherein said at least one interior side wall is joined to said first and second exterior wall on peripheral edges.

16. A safety bag for packaging fluid sample containers which comprises at least a first and second non-porous exterior side walls joined to form an interior chamber with an opening for access into said interior chamber, said opening including means for forming a fluid tight closure, said interior chamber being subdivided into a primary compartment for holding liquid containers and at least one secondary compartment for collecting liquids discharged from the containers in said primary compartment, said primary and secondary compartments defined by an interior divider comprising multiple plies of a porous one-way film having openings characterized by tapered protuberances through which leaking fluids from said primary compartment are discharged into said secondary compartment, said secondary compartment having means for absorbing fluid discharged therein.

17. The safety bag of claim 16 fabricated at least in part with a polymeric film.

18. The safety bag of claim 16 wherein said tapered protuberances of one-way porous film have generally a funnel-like configuration narrowing in the direction of the non-porous exterior side wall.

19. The safety bag of claim 16 wherein said means for absorbing fluid is a cellulosic material.

20. The safety bag of claim 16 wherein said means for absorbing fluid is a member selected from the group consisting of cellulosic material, natural sponges, and synthetic sponges.

21. The safety bag of claim 16 wherein said multiple plies of one-way porous film comprises different grades of porous film.

22. The safety bag of claim 16 wherein said one-way porous interior wall is characterized by regularly spaced pores having an open area of about 15 to about 26 percent.

23. The safety bag of claim 16 wherein said multiple plies of one-way porous film comprises the same grade of porous film.

24. The safety bag of claim 16 wherein said fluid tight closure is a member selected from the group consisting of a reclosable zipper and snap lock strip.

25. The safety bag of claim 16 wherein said non-porous exterior side wall is sealed to said one-way porous interior side wall below the fluid tight closure thereby forming a sealed secondary compartment having said absorbent material sealed therein.

* * * * *